US007722269B2

(12) United States Patent
Kitabatake

(10) Patent No.: US 7,722,269 B2
(45) Date of Patent: May 25, 2010

(54) PRINTING APPARATUS

(75) Inventor: Tetsuya Kitabatake, Fukushima (JP)

(73) Assignee: Oki Data Corporation, Tokyo (JP)

( * ) Notice: Subject to any disclaimer, the term of this patent is extended or adjusted under 35 U.S.C. 154(b) by 1046 days.

(21) Appl. No.: 11/142,977

(22) Filed: Jun. 2, 2005

(65) Prior Publication Data

US 2006/0028518 A1 Feb. 9, 2006

(30) Foreign Application Priority Data

Jun. 7, 2004 (JP) ..... 2004-168432

(51) Int. Cl.
*B41J 19/30* (2006.01)
*B41J 32/02* (2006.01)

(52) U.S. Cl. ..... 400/323; 400/207; 400/208; 347/86; 347/214

(58) Field of Classification Search ..... 400/323, 400/207, 208, 191, 357; 347/86, 214
See application file for complete search history.

(56) References Cited

U.S. PATENT DOCUMENTS 4,787,616 A * 11/1988 Sasaki et al. ..... 271/3.03
6,530,634 B1 * 3/2003 Hara ..... 347/7
6,964,475 B2 * 11/2005 Nebashi et al. ..... 347/101

FOREIGN PATENT DOCUMENTS

JP 05104797 A 4/1993
JP 8-318666 A 12/1996

* cited by examiner

*Primary Examiner*—Judy Nguyen
*Assistant Examiner*—Marissa L Ferguson-Samreth
(74) *Attorney, Agent, or Firm*—Panitch Schwarze Belisario & Nadel LLP

(57) ABSTRACT

A printing apparatus comprises a print head, disposed to a horizontally movable carriage, for printing a recording medium, a print cartridge disposed in a detachably attachable manner to said print head, and a member disposed in a range including an operating range for attaching and detaching said print cartridge, wherein said member has at least a portion positioned in said operating range for attaching and detaching said print cartridge, and wherein the portion is escapable from said operating range for attaching and detaching said print cartridge.

19 Claims, 10 Drawing Sheets

PRINTING APPARATUS

BACKGROUND OF THE INVENTION

1. Field of the Invention

This invention relates to a printing apparatus for making printing on paper in using a print head upon mounted with a detachably attachable ink cartridge and, more particularly, to an impact printer or an inkjet printer enabling to guide certainly paper near the print head.

2. Description of Related Art

As a printing apparatus upon installed with a ribbon cartridge, there has conventionally been an apparatus such as disclosed in Japanese Patent Application Publication No. JA-H8-318,666, in which the ribbon cartridge as well as the print head are installed to a carriage and printing is operated while moving the carriage. On the apparatus of this type, a feed roller is arranged near the print head to load smoothly a paper to a position to be printed with the print head. Furthermore, a paper guide is also arranged near the print head to convey smoothly curled paper or dog-eared paper as well.

Where the paper guide is arranged near the carriage, when the ribbon cartridge is attached or detached, the ribbon cartridge hits against the paper guide, so that the ribbon cartridge cannot be attached or detached. Therefore, a position at which the ribbon cartridge is attached and detached, i.e., an attaching and detaching position, is conventionally predetermined to attach or to detach the ribbon cartridge thereat. The paper guide is not disposed near the print head at the attaching and detaching position.

Where replacing the ribbon cartridge, the carriage is moved to the predetermined attaching and detaching position, and the ribbon cartridge is detached from the carriage. A new ribbon cartridge is then installed to the carriage. In this bout, the paper guide does not prevent the replacement of the ribbon cartridge since not disposed near the carriage. It is to be noted that the ribbon cartridge's attaching and detaching position is disposed within a range of paper conveyance.

However, with the conventional apparatus as described above, since the ribbon cartridge's attaching and detaching position is disposed in the range of the paper conveyance, the curled paper is held, where guided, at the ribbon cartridge attaching and detaching position, so that there has been such a problem as causing the paper to get damaged, folded, or jammed. Where the attaching and detaching portion for the ribbon cartridge is disposed out of the range of the paper conveyance to avoid such a problem, the apparatus becomes larger in size.

Furthermore, since the paper guide is not disposed at the ribbon cartridge's attaching and detaching position, a sensor for detecting the paper cannot be disposed to the paper guide. Thus, there has been such a problem also, as limiting a paper detection control.

SUMMARY OF THE INVENTION

To solve above problems, a printing apparatus according to this invention, for printing a paper in using a print head upon mounted with a detachably attachable print cartridge, is characterized in enabling at least one of members disposed in an operating range for attaching and detaching a print cartridge to be escapable from the attaching and detaching operating range.

According to this invention thus structured, it becomes possible to dispose, e.g., a member for guiding a paper at a ribbon cartridge attaching and detaching position, so that the printing apparatus has an effect such as preventing the paper from getting caught even where the dog-eared paper is conveyed, without becoming larger in size. Furthermore, a sensor for detecting the paper can be disposed to this member.

BRIEF DESCRIPTION OF THE DRAWINGS

This invention may take physical form in certain parts and arrangements of parts, a preferred embodiment and method of which will be described in detail in this specification and illustrated in the accompanying drawings which form a part hereof, and wherein.

DETAILED DESCRIPTION OF PREFERRED EMBODIMENTS OF THE INVENTION

Figure 1:
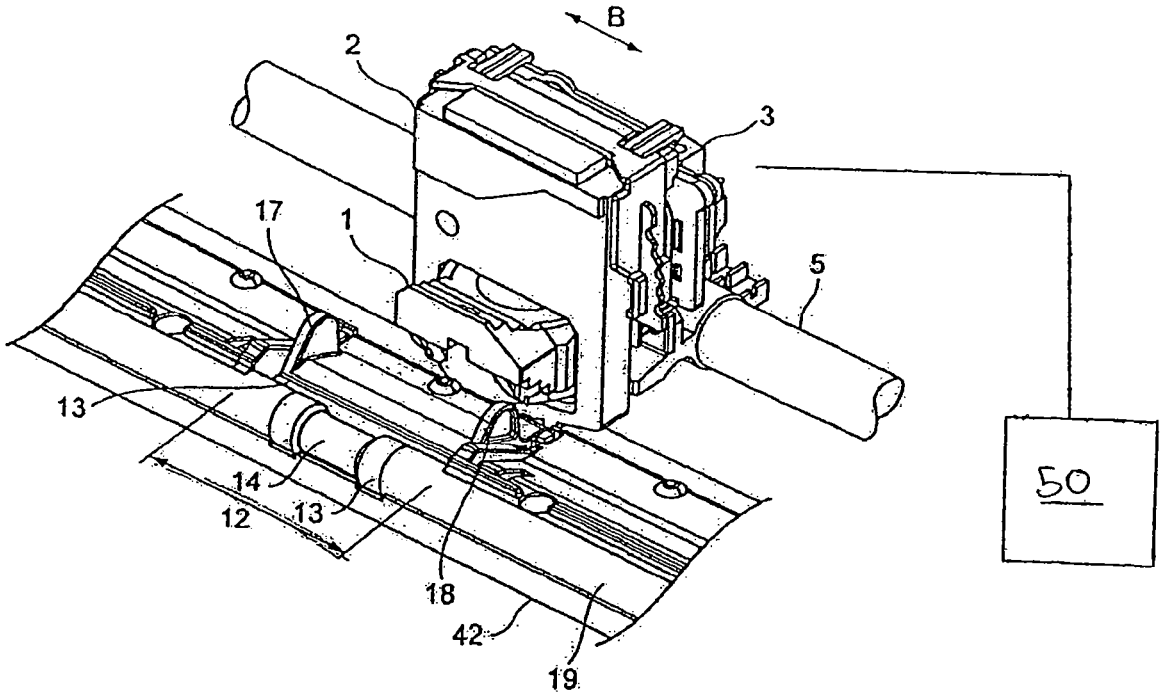
FIG. 1 is a perspective view showing an essential part according to the first embodiment of this invention.
Figure 2:
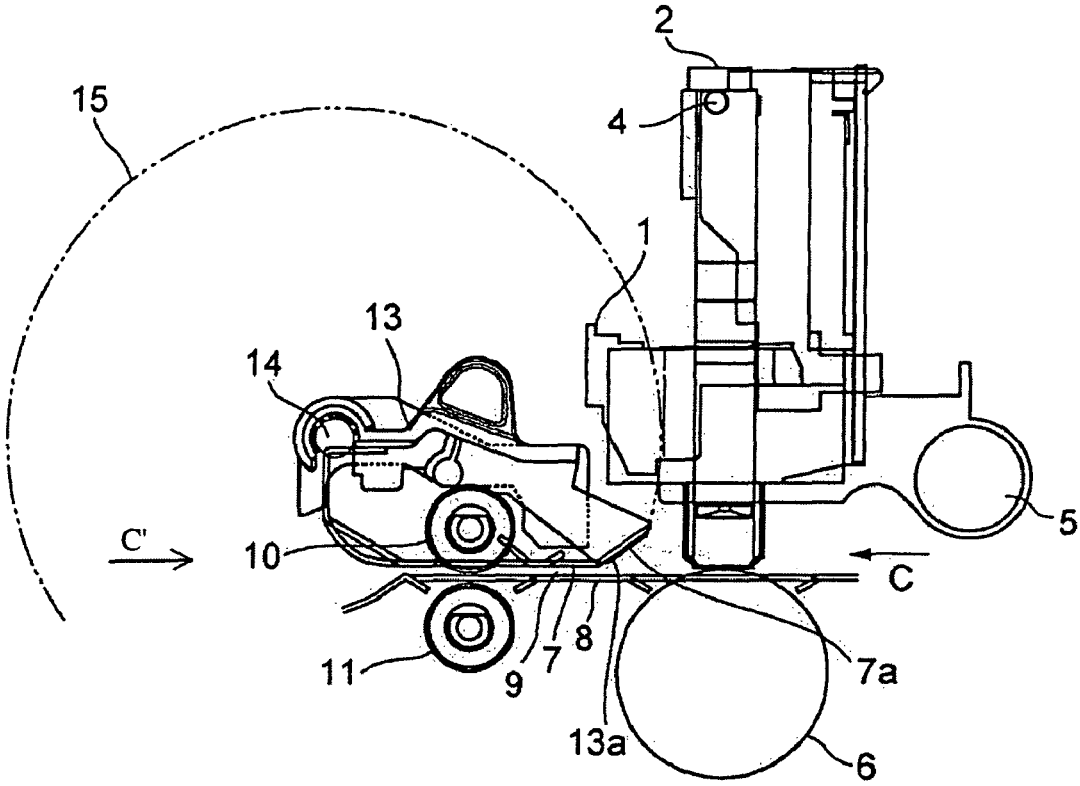
FIG. 2 is a side view showing the essential part according to the first embodiment.
Figure 3:
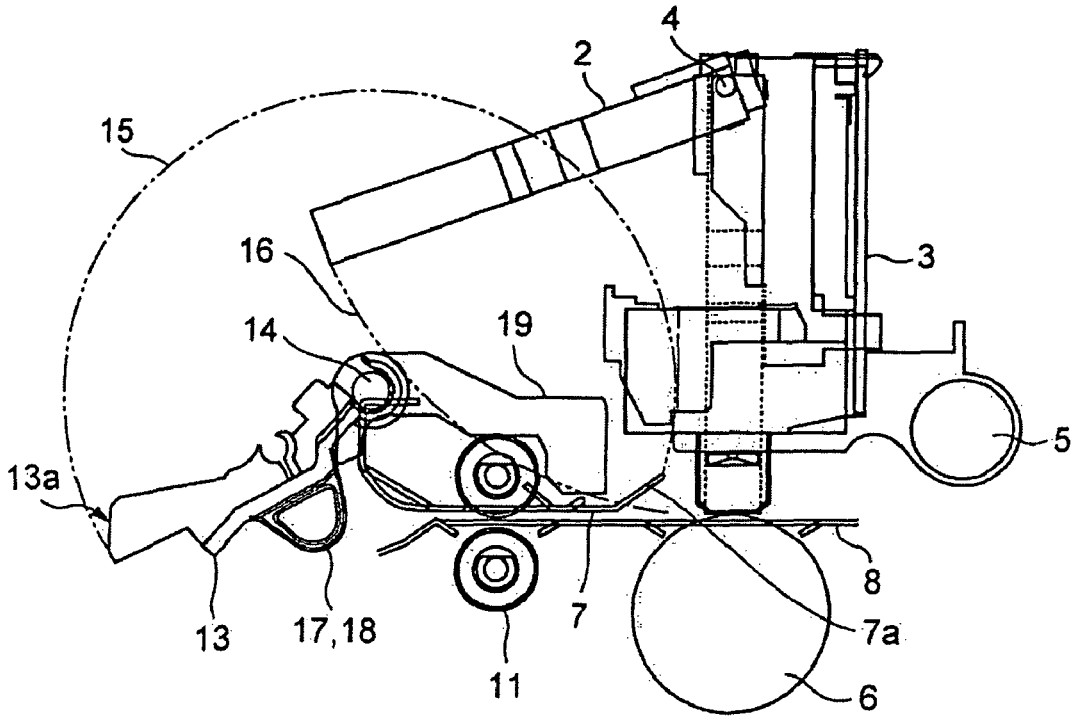
FIG. 3 is a side view showing the essential part according to the first embodiment.
Figure 12:
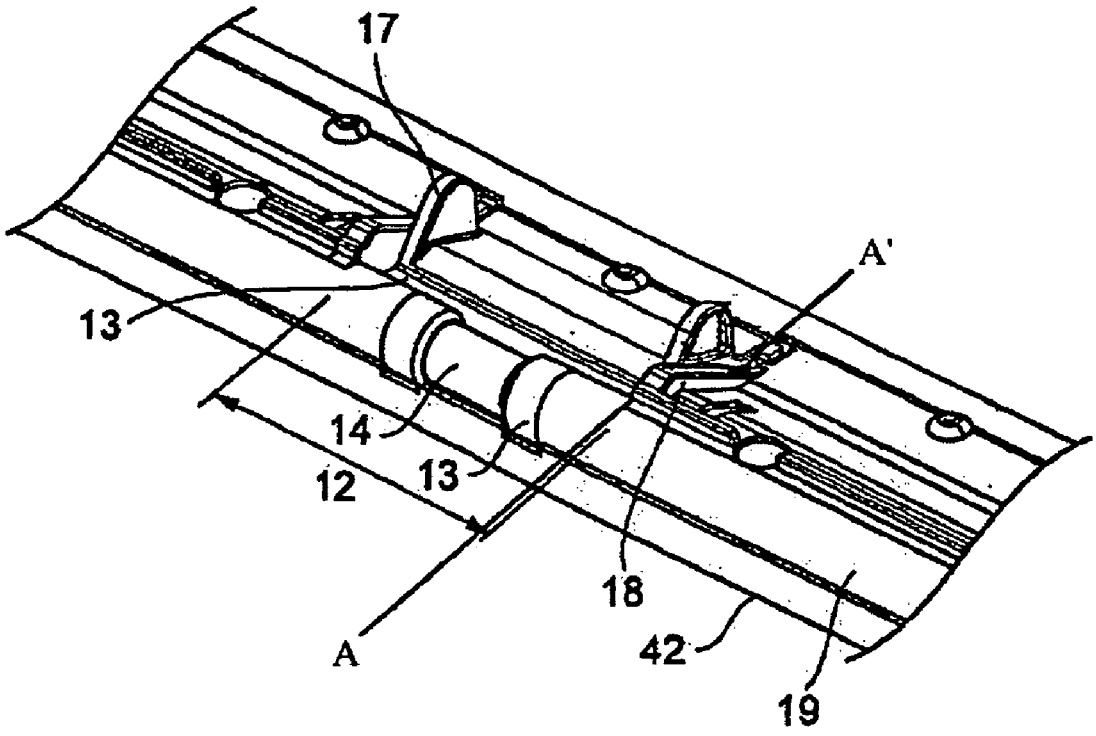
FIG. 12 is a perspective view showing the essential part according to the first embodiment.

Hereinafter, embodiments to carry out this invention will be described in reference to drawings. FIG. 1 and FIG. 12 are perspective views showing an essential part according to the first embodiment of this invention while FIG. 2 and FIG. 3 are side views showing the essential part at a cross section taken along line AA' in FIG. 12 according to the first embodiment. In these drawings, a print head 1 and a ribbon cartridge 2 are mounted to a carriage 3. The ribbon cartridge 2 is supported in a pivotally movable manner with a pivotal center 4 disposed to the carriage 3 while detachably attached to the pivotal center 4. The ribbon cartridge 2 is locked with a locking machinery, not shown, in a condition where completely installed as shown in FIG. 2.

The carriage 3 is axially supported in a slidable manner with a shaft 5 and can be moved in direction of arrow B along the shaft 5 with a driving source, not shown. A platen 6 is placed as facing under the print head 1. Though the paper is conveyed between the print head 1 and the platen 6, an upper side guide 7 and a lower side guide 8 are arranged in a manner to sandwich therebetween an area including a contact position between the print head 1 and the platen 6. The upper side guide 7 is formed as extending up to near a printing position between the print head 1 and the platen 6. The upper side guide 7 and the lower side guide 8 constitute a paper conveyance route 9. The paper is conveyed on the paper conveyance route 9 in a direction of arrow C' when printed, and conveyed in a direction of arrow C when discharged. As shown in FIG.

2 and FIG. 3, the upper side guide 7 is formed with an inclined guide portion 7*a* with which the paper moved through the print head 1 is guided into the paper conveyance route 9 when discharged. A pair of feed rollers 10, 11 are disposed on a downstream side in the paper conveyance direction when discharging paper, with respect to the print head 1 and the platen 6.

In FIG. 1, the printing apparatus has a cartridge attaching and detaching position 12. The ribbon cartridge 2 is attached and detached at this position, but the upper side guide 7 as described above is not disposed at the cartridge attaching and detaching position 12 to ensure an operating range for attaching and detaching the ribbon cartridge 2. The ribbon cartridge 2 therefore does not come in contact with the upper side guide 7 when attached and detached.

An opening and closing guide member 13 is disposed at the cartridge attaching and detaching position 12. The opening and closing guide member 13 constitutes one part of the upper guide 7. The opening and closing guide member 13 is supported in a pivotally movable manner with a shaft 14, and has a structure such as guiding the paper in a closed state, i.e., in a state as shown in FIG. 1 and FIG. 2, likewise the upper side guide 7, and has an inclined guide portion 13*a* formed near the print head 1. The inclined guide portion 7*a* of the upper side guide 7 and the inclined guide portion 13*a* of the opening and closing guide member 13 have an inclination in a shape approximately corresponding to each other when viewed from a side as shown in FIG. 2. When closed, the opening and closing guide member 13 is locked with the locking machinery, not shown. In this bout, the inclined guide portion 13*a* of the opening and closing guide member 13 covers an approximately entire area in a horizontal direction at the cartridge attaching and detaching position 12. Therefore, the inclined guide portion 13*a* and the inclined guide portion 7*a* of the upper side guide 7 at opposite side ends of the inclined guide portion 13*a* cover up the entire range of a paper conveyance region. A cover 19 for covering a feed roller 10 is equipped above the feed roller 10.

A double-dashed chain line in FIG. 2 and FIG. 3 shows a trajectory 15 of an front end portion of the opening and closing guide member 13 as pivotally moved. As can be expected from this, where the carriage 3 is positioned at the cartridge attaching and detaching position 12, the opening and closing guide member 13 and the print head 1 are set in a positional relation such that the opening and closing guide member 13 interferes with the print head 1 when closed and opened. In a completely opened state, the opening and closing guide member 13 is positioned, as shown in FIG. 3, at a position distant from a trajectory 16 of the front end portion of the ribbon cartridge 3 as pivotally moved around a pivotal center 4 as a center. The trajectory 16 shows the operating range for attaching and detaching the ribbon cartridge 2. It is to be noted that the feed roller 10 is disposed not at the cartridge attaching and detaching position 12, but at an outside of the position. Furthermore, the opening and closing guide member 13 is formed with levers 17, 18 in a ring shape.

Operation of the first embodiment will be described next. Herein, manipulations for replacement of the ribbon cartridge are mostly described. The carriage 3 is positioned at the cartridge attaching and detaching position 12 when the printing is completed. The carriage 3 then escapes from the cartridge attaching and detaching position 12 upon pushing a carriage escaping switch (inputting means 50, see FIG. 1). In this case, the carriage 3 may be moved in either left or right direction as long as separated from the carriage attaching and detaching position 12. The locking machinery, not shown, of the opening and closing guide member 13 is next released, and the opening and closing guide member 13 is pivotally moved around the shaft 14 as a center so as to be opened from what is in a closed state as shown in FIG. 2, upon picking up the levers 17, 18, or namely, the opening and closing guide member 13 is escaping from the vicinity of the print head 1. In this bout, because the carriage escapes, the opening and closing guide member 13 does not interfere with the print head 1.

The opening and closing guide member 13 is opened up to a position as shown in FIG. 3. The carriage 3 is then replaced from an escaping position to the cartridge attaching and detaching position 12 upon pushing a carriage replacing switch (inputting means 50, see FIG. 1). The locking machinery, not shown, fastening the installment of the ribbon cartridge 2 is released, and the ribbon cartridge 2 is then pivotally moved as lifted upward around the pivotal center 4 as the center, as shown in FIG. 3, thereby being detached from the carriage 3. While the ribbon cartridge 2 is pivotally moved, since the opening and closing guide member 13 escapes to a position such as not interfering with the opening and closing guide member 13, the ribbon cartridge 2 does not interfere with the opening and closing guide member 13.

The new ribbon cartridge 2 is thereafter installed. The ribbon cartridge 2 is mounted according to the steps in the reverse order to the steps for detachment. That is, one end of the ribbon cartridge 2 is first fit into the pivotal center 4, and the ribbon cartridge 2 is next pivotally moved in a downward direction to be installed in a state as shown in FIG. 2, thereby being fastened with the lock machinery, not shown. Subsequently, the carriage 3 escapes again from the cartridge attaching and detaching position 12 to close the opening and closing guide member 13, thereby being rendered in a state as shown in FIG. 2. The opening and closing guide member 13 is then fastened with the locking machinery, not shown.

Where the printing is operated, the paper is first conveyed in the direction of the arrow C' as shown in FIG. 2, thereby conveyed and discharged in the direction of the arrow C when the printing is completed. At that time, the opening and closing guide member 13 is positioned at the cartridge attaching and detaching position 12, and the inclined guide portion 13*a* of the opening and detaching guide member 13 guides, so that even the curled paper can be guided appropriately, thereby avoiding paper jamming or paper folding.

According to the first embodiment as described above, the opening and closing guide member 13 is placed in an escapable manner at the cartridge attaching and detaching position 12, and the paper is to be guided with the inclined guide portion 13*a* of the opening and closing guide member 13 during printing, while the opening and closing guide member 13 is to escape when the ribbon cartridge 2 is replaced, so that a conveyance property of the paper can be improved, and so that the apparatus can convey stably even the curled paper.

Figure 4:
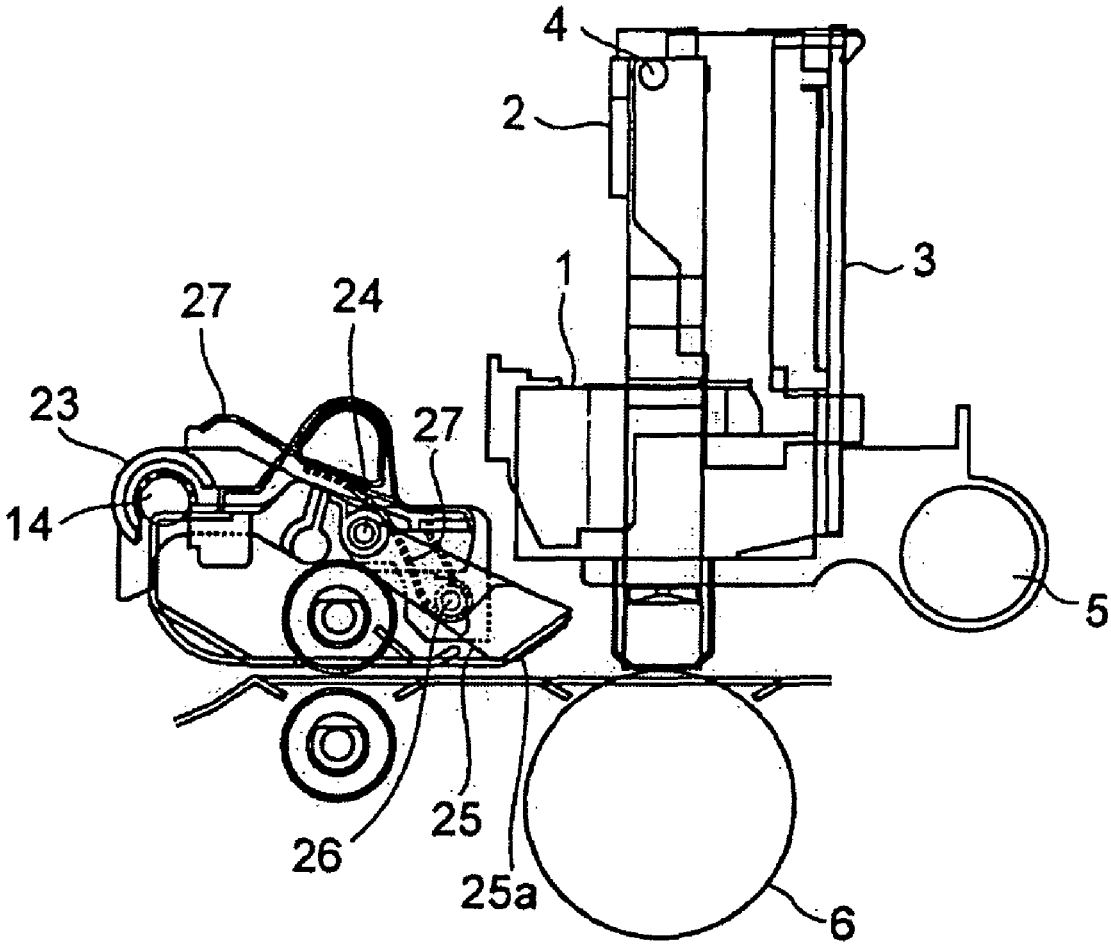
FIG. 4 is a side view showing an essential part according to the second embodiment.
Figure 5:
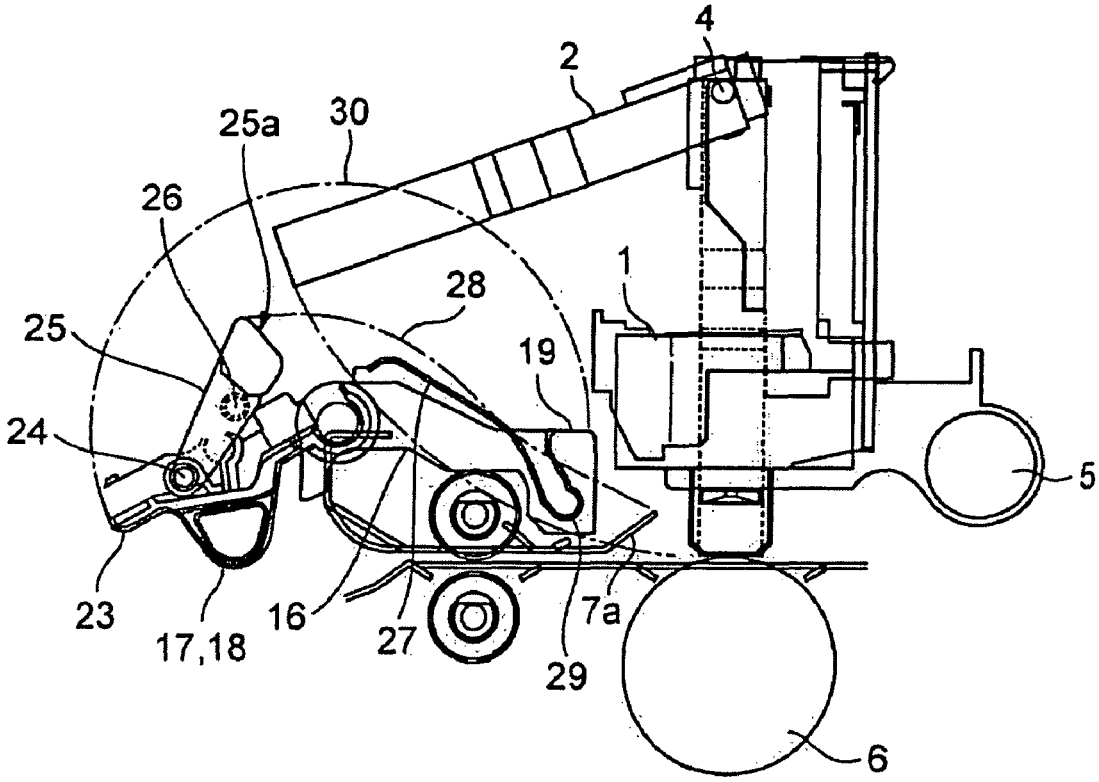
FIG. 5 is a side view showing the essential part according to the second embodiment.

The second embodiment will be described next. FIG. 4 and FIG. 5 are side views showing an essential part according to the second embodiment. In addition to the structure of the first embodiment, an auxiliary guide member is disposed to the opening and closing guide member in the second embodiment.

In FIG. 4 and FIG. 5, an opening and closing guide member 23 is disposed at the cartridge attaching and detaching position, in which the opening and closing guide member 23 is disposed in a pivotally movable manner to the shaft 14. The opening and closing guide member 23 is disposed with a pivotal movement center 24, in which the pivotal movement center 24 is disposed with an auxiliary guide member 25 in a pivotally movable manner. The auxiliary guide member 25 has approximately the same width as the opening and closing guide member 23, in which an inclined guide portion 25*a* is formed to a front end portion of the auxiliary guide member 25. The inclined guide portion 25*a* is formed to take up an approximately entire area in a horizontal direction at the cartridge attaching and detaching position.

Figure 6:
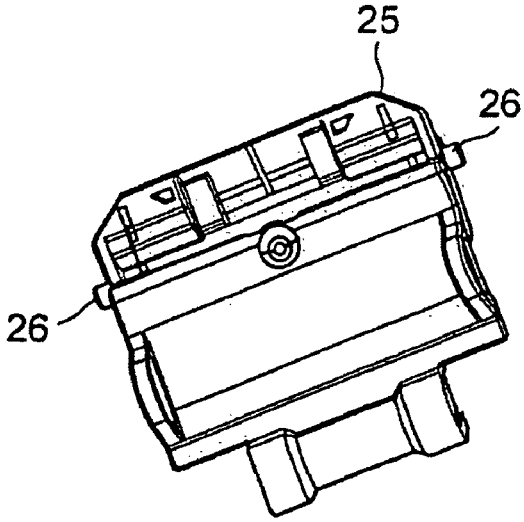
FIG. 6 is a perspective view showing an opening and closing guide member and an auxiliary guide member according to the second embodiment.

A boss portion 26 is formed at each end side of the auxiliary guide member 25, as shown in FIG. 6. FIG. 6 is a perspective view showing the opening and closing guide member and the auxiliary guide member. A cam guide portion 27 is formed on a side of the opening and closing guide member 23 with respect to each of the covers 19 positioned at left and right sides of the opening and closing guide member 23. The boss portions 26 of the auxiliary guide member 25 are movable upon sliding on the cam guide portions 27. The cam guide portion 27 is shaped in a manner to guide the boss portions 26 so that the trajectory 28, shown in FIG. 5, of the front end portion of the auxiliary guide portion 25, when the auxiliary guide portion 25 is pivotally moved around the pivotal movement center 24 as the center where the opening and closing guide member 23 is opened or closed, forms a route avoiding the print head 1 above the carriage 3 positioned at the cartridge attaching and detaching position at the time. It is to be noted that the opening and closing guide member 23 is set in a size such that the opening and closing guide member 23 can be opened in a manner that the print head 1 does not interfere with a trajectory 30 drawn by the opening and closing guide member 23, as shown in FIG. 5, where the opening and closing guide member 23 is opened from the closed state of the member.

An engaging portion 29 for engaging the boss portion 26 is formed at a front end portion, or namely on a side of the carriage 3, of the cam guide portion 27. The engaging portion 29 is shaped in a groove form, and engages with the boss portion 26 when the opening and closing guide member 23 is completely closed.

Likewise the first embodiment, the opening and closing guide member 23 is, where in a completely closed state, positioned in the range at which the ribbon cartridge 2 is pivotally moved when attached or detached, while being positioned, where in an opened state as shown in FIG. 5, out of the above range, together with the auxiliary guide member 25. The other structures are the same as the first embodiment.

Figure 7:
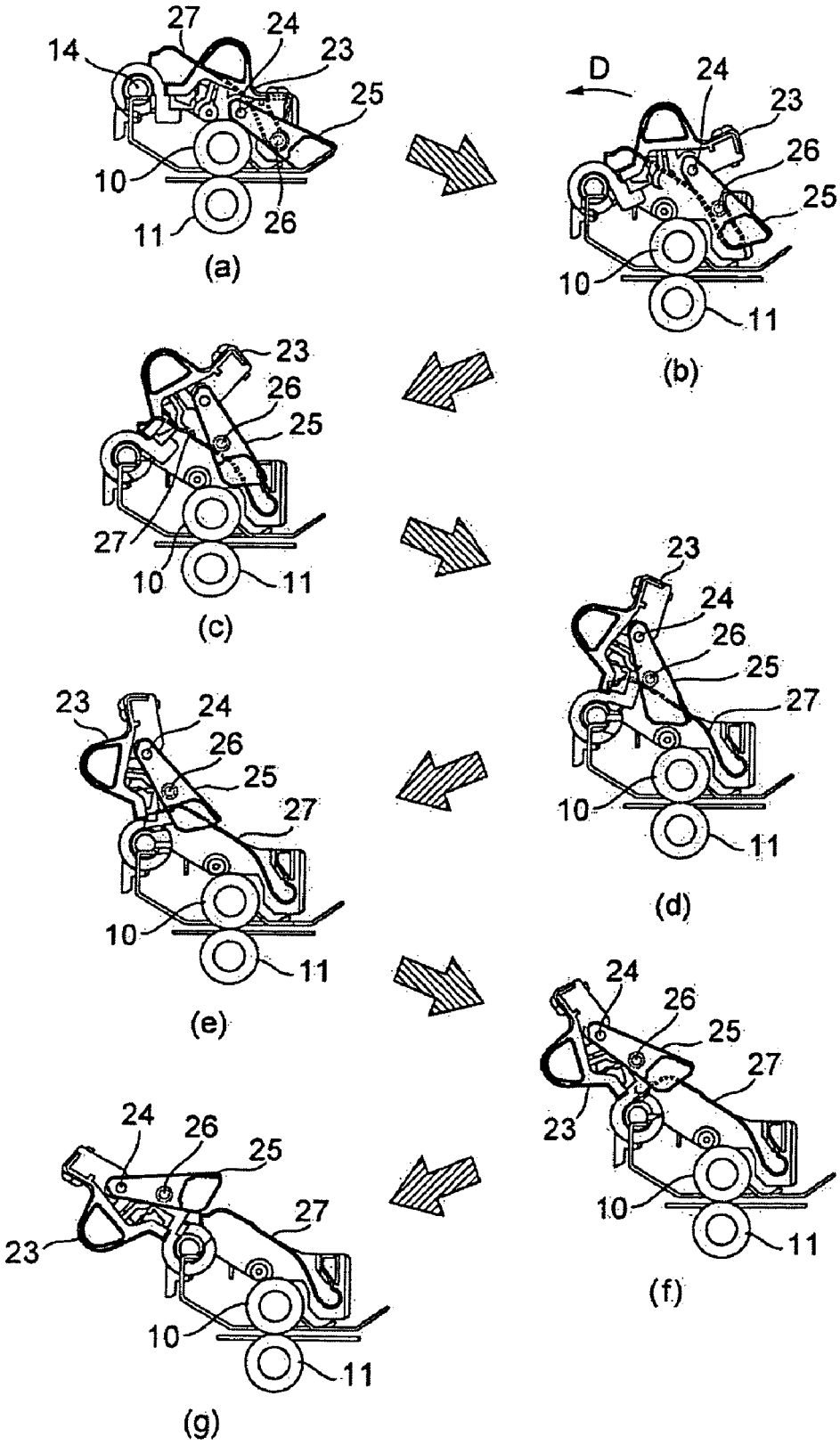
FIG. 7 is a view illustrating operation of the second embodiment.

Operation of the second embodiment will be described next. FIG. 7 is a view illustrating the operation of the second embodiment. When the printing is completed, the carriage 3 is positioned at the cartridge attaching and detaching position 12, however, in the second embodiment, the carriage 3 does not need to escape, not likewise the first embodiment, from the cartridge attaching and detaching position 12 to replace the ribbon cartridge 2. Even where the carriage 3 is positioned at the cartridge attaching and detaching position, the locking machinery, not shown, of the opening and closing guide member 23 is released, and the opening and closing guide member 23 is pivotally moved in a direction of arrow D around the shaft 14 as a center so as to be opened from in a closed state as shown in FIG. 7(*a*), upon picking the levers 17, 18.

In a state where the opening and closing guide member 23 is closed, the boss portion 26 of the auxiliary guide member 25 engages with the engaging portion 29 of the cam guide portion 27 but lifted upward from the engaging portion 29 in the groove form as the opening and closing guide member 23 is lifted upward. The opening and closing guide member 23 shifts its state to a state shown in FIG. 7 (*c*) and further in a state shown in FIG. 7 (*d*) from a state shown in Fig. (b). At that time, the opening and closing guide member 23 is pivotally moved with the front end portion thereof drawing the trajectory 30 as shown in FIG. 5 while not interfering with the print head 1.

In this state, the auxiliary guide member 25 is, after pulled out of the engaging portion 29, pivotally moved around the pivotal movement center 24 as the center in a counterclockwise direction with respect to the opening and closing guide member 23, as the boss portions 26 are moved upon sliding on the cam guide portion 27 because of the self-weight of the auxiliary guide member 25. According to this moving operation, the front end portion of the auxiliary guide member 25 draws the trajectory 28 as shown in FIG. 5, and does not interfere with the print head 1.

The opening and closing guide member 23 is further opened up to positions shown in FIGS. 7(*e*) to 7(*g*), thereby being finally rendered in a completely opened state as shown in FIG. 5. In a state where the opening and closing guide member 23 is completely opened, the boss portion 26 of the auxiliary guide member 25 is separated from the cam guide portion 27 but held with a holding means, not shown, at a prescribed position with respect to the opening and closing guide member 23.

Herein, the ribbon cartridge 2 is replaced. In the same way as the first embodiment, the locking machinery, not shown, fastening the installment of the ribbon cartridge 2 is released, and the ribbon cartridge 2 is then pivotally moved as lifted upward around the pivotal center 4 as the center, as shown in FIG. 5, thereby detached from the carriage 3. While the ribbon cartridge 2 is pivotally moved, since the opening and closing guide member 23 as well as the auxiliary guide member 25 escape to a position such as not interfering, the ribbon cartridge 2 does not interfere with the opening and closing guide member 23 neither the auxiliary guide member 25.

Herein, where the carriage 3 is not positioned at the cartridge attaching and detaching position, the ribbon cartridge 2 is detached after the carriage 3 is moved to the cartridge attaching and detaching position.

A new ribbon cartridge 2 is thereafter installed. The ribbon cartridge 2 is installed according to the steps in the order reverse to the steps when detached. That is, one end of the ribbon cartridge 2 is first fit into the pivotal center 4, and the ribbon cartridge 2 is next pivotally moved downward to be installed in a state as shown in FIG. 2, thereby being fastened with the lock machinery, not shown.

Thereafter, the opening and closing guide member 23 is closed without moving the carriage 3. When closing the opening and closing guide member 23, the boss portion 26 of the auxiliary guide member 25 engages with the cam guide portion 27, thereby moving along the cam guide portion 27. In a state where completely closed, the opening and closing guide member 23 is fastened with the locking machinery, not shown. At that time, the boss portion 26 is engaged with the engaging portion 29.

The printing is operated in the same way as the first embodiment but the paper conveyed through the upper side 7 of the print head 1 is guided with the inclined guide portion 25*a* of the auxiliary guide member 25 as well as the inclined guide portion 7*a* of the upper side guide 7. Therefore, even the curled paper can be guided appropriately, thereby not happening to get jammed or folded.

According to the second embodiment as described above, in addition to the same advantages as the first embodiment, the ribbon cartridge 2 can be replaced without escaping the carriage 3 from the cartridge attaching and detaching position, upon enabling the opening and closing guide member 23 and the auxiliary guide member 25 to escape without interfering with the print head 1. That is, the second embodiment has an effect such as eliminating complication such as escaping the carriage 3 every time when opening or closing the opening and closing guide member 23.

Figure 8:
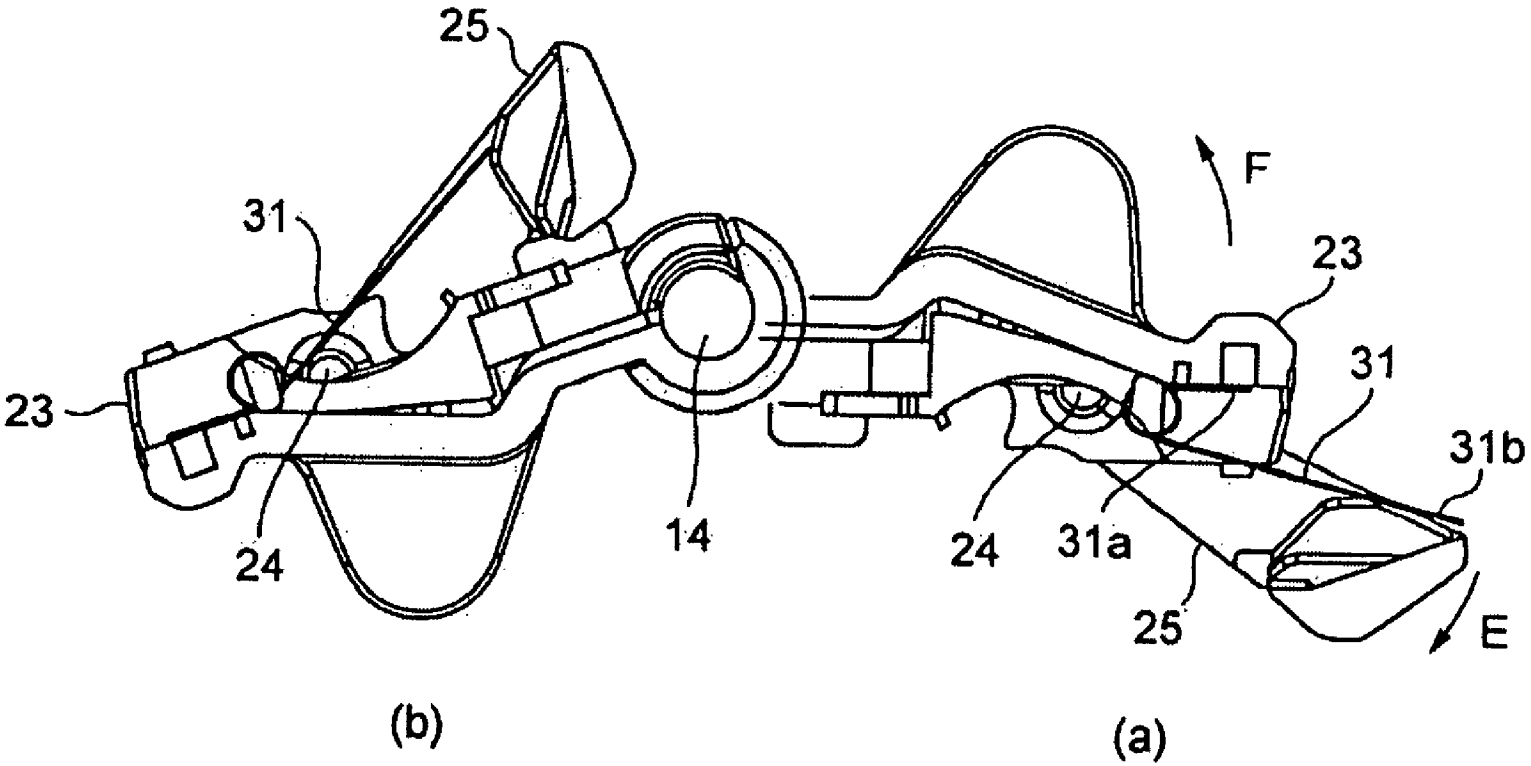
FIG. 8 is a side view showing the third embodiment.
Figure 9:
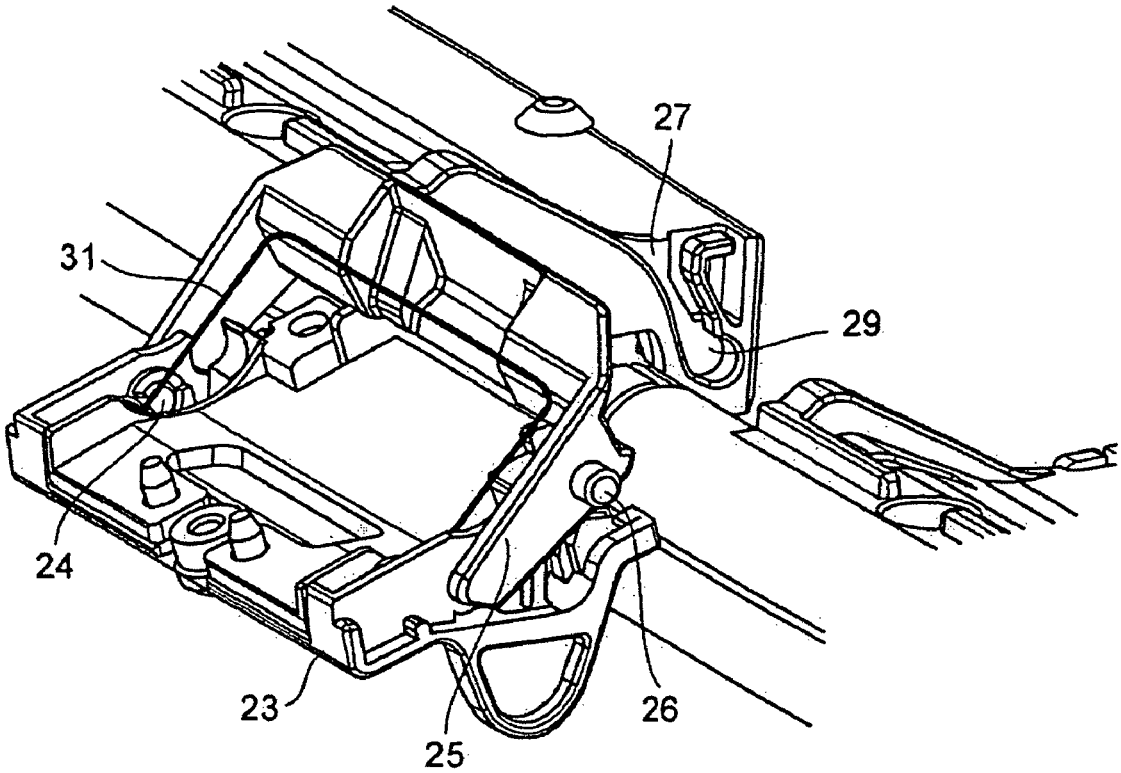
FIG. 9 is a perspective view showing an opening and closing guide member and an auxiliary guide member according to the third embodiment.
Figure 10:
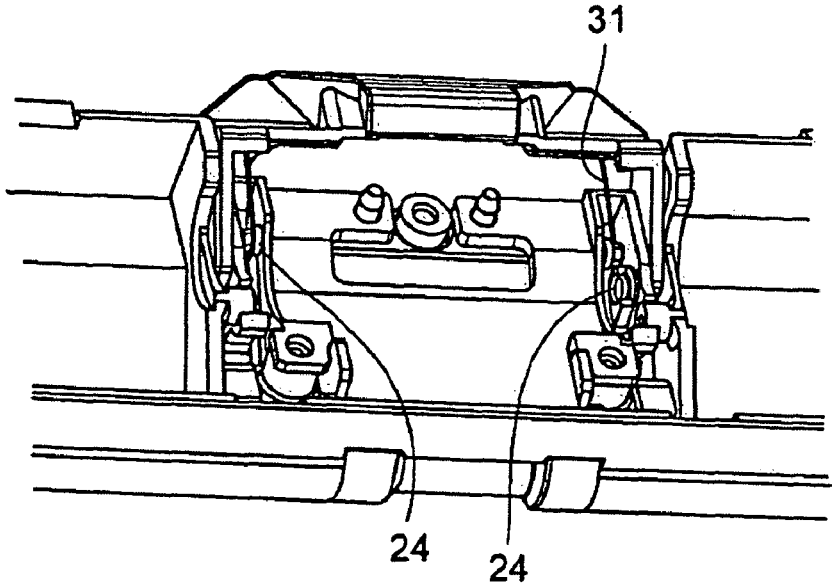
FIG. 10 is a perspective view showing the opening and closing guide member and the auxiliary guide member according to the third embodiment.

The third embodiment will be described next. In addition to the structure of the second embodiment, an urging member for urging the auxiliary guide member is disposed in the third embodiment. FIG. 8 is a side view showing the opening and closing guide member and the auxiliary guide member according to the third embodiment, while FIG. 9 and FIG. 10 are perspective views showing the opening and closing guide member and the auxiliary guide member according to the third embodiment. It is to be noted that FIG. 8 shows the opening and closing guide member in both a closed state (a) and an opened state (b), FIG. 9 shows the opening and closing guide member in an opened state, and FIG. 10 shows a rear surface of the opening and closing guide member as well as the auxiliary guide member in a closed state.

In those drawings, the opening and closing guide member 23 is disposed with a torsion spring 31 serving as the urging member for urging the auxiliary guide member 25. The torsion spring 31 has one end 31*a* engaged with the opening and closing guide member 23 and the other end 31*b* engaged with the auxiliary guide member 25, thereby urging in a manner to pivotally rotate the auxiliary guide member 25 in a direction of arrow E. Therefore, the boss portions 26 of the auxiliary guide member 25 are always pushed to the lower side of the cam guide portions 27. The other structure is the same as the second embodiment. The third embodiment is also structured so that the opening and closing guide member 23 and the auxiliary guide member 25 do not interfere with the print head when the opening and closing guide member 23 is opened or closed.

Operation of the third embodiment will be described next. The operation of the third embodiment is basically the same as that of the second embodiment, but operation of the auxiliary guide member 25 at the time of replacement of the ribbon cartridge will be described herein. Where releasing the locking machinery, not shown, fastening the opening and closing guide member 23 in a closed state, the boss portions 26 of the auxiliary guide member 25 are pushed to the lower side of the cam guide portions 27 upon an urging force with the torsion spring 31. A reaction force generated by the above described movement lifts the pivotal movement center 24 upward.

Since the pivotal movement center 24 is disposed to the opening and closing guide member 23, the opening and closing guide member 23 is pivotally moved around the pivotal center 14 as the center in a direction of arrow F as shown in FIG. 8, i.e., in an opening direction, as the pivotal movement center 24 is lifted up. That is, when releasing the locking machinery, the opening and closing guide member 23 is raised upward in the opening direction upon the urging force with the torsion spring 31.

While the boss portions 26 are in contact with the cam guide portion 27, the torsion spring 31 keeps on opening the opening and closing guide member 23. At the time that the boss portions 26 are separated from the cam guide portion 27, the opening and closing guide member 23 is positioned at a position outside the range at which the ribbon cartridge 2 is pivotally moved. The opening and closing guide member 23 is maintained at the above position. The torsion spring 31 even thereafter keeps on urging and holds the auxiliary guide member 25 at the predetermined position with respect to the opening and closing guide member 23 in a completely opened state as shown in FIG. 8(*a*) and FIG. 9.

When the opening and closing guide member 23 is, where closed, moved in a closing direction, the boss portions 26 of the auxiliary guide member 25 come in contact, in a sliding manner, with the cam guide portions 27. The opening and closing guide member 23 is even further closed, the auxiliary guide member 25 is moved along the cam guide portion 27. The opening and closing guide member 23 is fastened, in a completely closed state, with the locking machinery, not shown. In this bout, the boss portion 26 is engaged with the engaging portion 29.

It goes without saying that the opening and closing guide member 23 and the auxiliary guide member 25 do not interfere with the print head 1 when the opening and closing guide member 23 is opened or closed.

According to the third embodiment as described above, in addition to the effect of the second embodiment, the opening manipulation can be facilitated since the urging member for urging the auxiliary guide member 25 is disposed so that the opening and closing guide member 23 as well as the auxiliary guide member 25 can be automatically opened only by releasing the locking machinery when opening the opening and closing guide member 23. Furthermore, when closing the opening and closing guide member 23 also, the urging member is to always push the boss portion 26 of the auxiliary guide member 25 to the cam guide portion 27, so that the auxiliary guide member 25 can be certainly moved along the cam guide portion 27.

Figure 11:
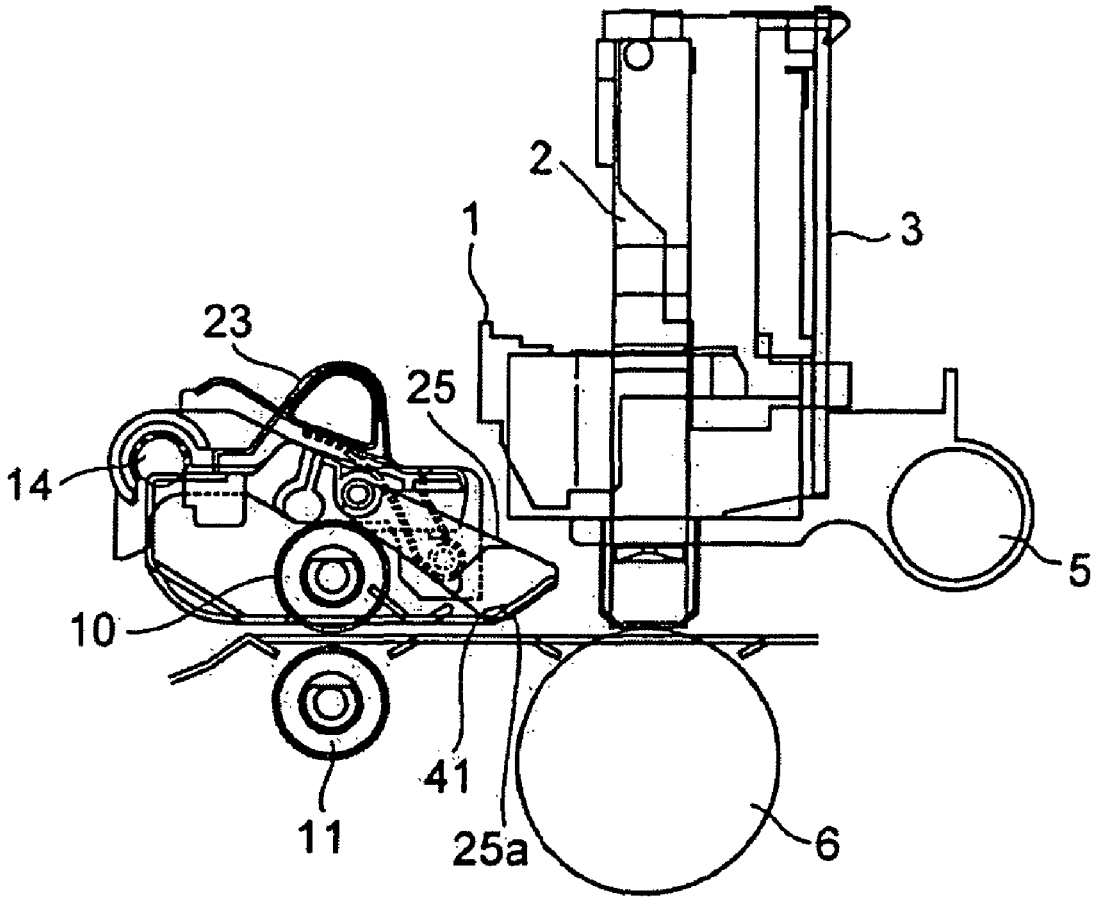
FIG. 11 is a view showing the fourth embodiment.

The fourth embodiment will be described next. In addition to the structure of the second embodiment, a sensor for detecting the paper is disposed at an end portion of the auxiliary guide member disposed to the opening and closing guide member in the fourth embodiment. FIG. 11 is a side view showing the fourth embodiment.

In FIG. 11, a paper detecting optical sensor 41 is disposed at the end portion of the auxiliary guide member 25, at a side of the print head 1. The paper detecting optical sensor 41 is disposed in a manner not to project from a lower end portion of the inclined guide portion 25*a* of the auxiliary guide member 25. The shaft 14 defined as the pivotal movement center for the opening and closing guide member 23 equipped with the auxiliary guide member 25 is set in a hollow form while having therein a wiring cord of the paper detecting optical sensor 41. The other structure is the same as the second embodiment.

The operation of the opening and closing guide member 23 and the auxiliary guide member 25 according to the fourth embodiment is the same as that of the second embodiment, so that the corresponding description is omitted. In the fourth embodiment, since the shaft 14 defined as the pivotal movement center for the opening and closing guide member 23 is always joined to the roller guide 42, shown in FIG. 1, at each side of the opening and closing guide member 23, the change of cord in length and route, with accompanying the opening and closing operation of the opening and closing guide member 23 can be minimized. As described above, since the paper detecting optical sensor 41 is installed, the paper of multiple kinds can be controlled while the paper can be conveyed more accurately.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but be defined by the claims set forth below.

What is claimed is:

1. A printing apparatus comprising:

a print head, disposed on a horizontally movable carriage, for printing a recording medium;

a print cartridge disposed in a detachably attachable manner to said print head; and a guide member disposed in a range including an operating range for attaching and detaching said print cartridge and for guiding conveyance of said recording medium, wherein said guide member comprises a movable member movable from a first position to a second position, wherein the first position is within a pivotal movement trajectory of the print cartridge such that the movable member will interfere with the pivotal movement of the print cartridge about a pivotal axis disposed on the carriage, and wherein the second position is outside of an exterior of the pivotal movement trajectory of the print cartridge such that the movable member will allow pivotal movement of the print cartridge about the pivotal axis disposed on the carriage.

2. The printing apparatus according to claim 1, wherein the movable member is pivotably connected to an auxiliary member, and wherein the auxiliary member is movable from a primary position to a secondary position, wherein the primary position is within a pivotal movement trajectory of the print cartridge such that the auxiliary member will interfere with the pivotal movement of the print cartridge about a pivotal axis disposed on the carriage, and wherein the secondary position is outside of an exterior of the pivotal movement trajectory of the print cartridge such that the auxiliary member will allow pivotal movement of the print cartridge about the pivotal axis disposed on the carriage.

3. The printing apparatus according to claim 2, wherein said printing apparatus comprises a guiding unit for guiding movement of said auxiliary member.

4. The printing apparatus according to claim 3, wherein said auxiliary member is configured to have a pivotal movement axis at said movable member and is configured to move along said guiding unit in conjunction with a movement of said movable member.

5. The printing apparatus according to claim 1, wherein said movable member has a pivotal movement axis at said printing apparatus.

6. The printing apparatus according to claim 1, wherein said carriage is positioned at an attaching and detaching position at which said print cartridge is attached and detached when printing is completed.

7. The printing apparatus according to claim 6, further comprising an inputting means for inputting an instruction for moving said carriage from said attaching and detaching position to an escaping position defined as an outside of said attaching and detaching range for said print cartridge and an instruction for moving said carriage from said escaping position to said attaching and detaching position.

8. A printing apparatus comprising:

a print head, disposed on a horizontally movable carriage, for printing a recording medium;

a print cartridge disposed in a detachably attachable manner to said print head; and a guide member disposed in a range including an operating range for attaching and detaching said print cartridge and for guiding conveyance of said recording medium, wherein the guide member comprises a movable member pivotably movable about a pivotal movement axis, the movable member being pivotably connected to an auxiliary member, and wherein the auxiliary member is movable from a first position to a second position, wherein the first position is within a pivotal movement trajectory of the print cartridge such that the auxiliary member will interfere with the pivotal movement of the print cartridge about a pivotal axis disposed on the carriage, and wherein the second position is outside of an exterior of the pivotal movement trajectory of the print cartridge such that the auxiliary member will allow pivotal movement of the print cartridge about the pivotal axis disposed on the carriage.

9. The printing apparatus according to claim 8, wherein said apparatus comprises a guiding unit for guiding movement of said auxiliary member.

10. The printing apparatus according to claim 9, wherein a weight of said auxiliary member contributes to a movement of said auxiliary member along said guiding unit.

11. The printing apparatus according to claim 9, wherein said movable member includes an urging member for urging said auxiliary member along said guiding unit.

12. The printing apparatus according to claim 11, wherein said guide member comprises a holding means for holding said auxiliary member in an engaging manner in a state that said auxiliary member enters in said operating range for attaching and detaching said print cartridge.

13. The printing apparatus according to claim 8, wherein said auxiliary member comprises a detection sensor for detecting said recording medium.

14. The printing apparatus according to claim 8, wherein the pivotal movement axis is at said printing apparatus.

15. The printing apparatus according to claim 8, wherein said carriage is positioned at an attaching and detaching position at which said print cartridge is attached and detached, when printing is completed.

16. The printing apparatus according to claim 15, further comprising an inputting means for inputting an instruction for moving said carriage from said attaching and detaching position to an escaping position defined as an outside of said attaching and detaching range for said print cartridge and an instruction for moving said carriage from said escaping position to said attaching and detaching position.

17. The printing apparatus according to claim 8, wherein a movement of the movable member about the pivotal movement axis coincides with the auxiliary member pivoting about a pivotal movement center at the movable member to move from the first position to the second position.

18. The printing apparatus according to claim 8, wherein the printing apparatus includes a guide portion to guide the movement of the auxiliary member such that a pivoting of the auxiliary member relative to the movable member results in a folded shape defined by the movable member and the auxiliary member.

19. A printing apparatus, comprising:

a print head, disposed on a horizontally movable carriage, for printing a recording medium;

a print cartridge disposed in a detachably attachable manner to said print head; and a movable member disposed in a range including an operating range for attaching and detaching said print cartridge, wherein said movable member is movable from a first position to a second position, wherein the first position is within a pivotal movement trajectory of the print cartridge such that the movable member will interfere with the pivotal movement of the print cartridge about a pivotal axis disposed on the carriage, and wherein the second position is outside of an exterior of the pivotal movement trajectory of the print cartridge such that the movable member will allow pivotal movement of the print cartridge about the pivotal axis disposed on the carriage.

* * * * *